US007385577B2

(12) United States Patent
Aoki

(10) Patent No.: US 7,385,577 B2
(45) Date of Patent: Jun. 10, 2008

(54) IMAGE SIGNAL CORRECTION METHOD, CORRECTION CIRCUIT, ELECTRO-OPTICAL DEVICE, AND ELECTRONIC APPARATUS

(75) Inventor: Toru Aoki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 785 days.

(21) Appl. No.: 11/006,699

(22) Filed: Dec. 8, 2004

(65) Prior Publication Data

US 2005/0156841 A1 Jul. 21, 2005

(30) Foreign Application Priority Data

Dec. 10, 2003 (JP) ..... 2003-411839
Nov. 18, 2004 (JP) ..... 2004-334048

(51) Int. Cl.
*G09G 3/36* (2006.01)

(52) U.S. Cl. ..... 345/87

(58) Field of Classification Search ..... 345/87–100, 345/204–213, 690–699
See application file for complete search history.

(56) References Cited

U.S. PATENT DOCUMENTS 6,829,392 B2 * 12/2004 Aoki ..... 382/275
7,148,871 B2 * 12/2006 Sekine ..... 345/98
2004/0196248 A1 * 10/2004 Sekine ..... 345/100
2005/0206597 A1 * 9/2005 Ishii ..... 345/87
2005/0219161 A1 * 10/2005 Aoki ..... 345/67
2006/0007208 A1 * 1/2006 Aoki ..... 345/204

FOREIGN PATENT DOCUMENTS

JP A-2001-337641 12/2001
JP A-2001-343923 12/2001
JP A-2002-149136 5/2002
JP A-2003-091270 3/2003
JP A-2003-099016 4/2003
JP A-2003-241220 8/2003

* cited by examiner

*Primary Examiner*—Sumati Lefkowitz
*Assistant Examiner*—Rodney Amadiz
(74) *Attorney, Agent, or Firm*—Oliff & Berridge, PLC

(57) ABSTRACT

To reduce a display irregularity when a phase expansion for grouping a plurality of data lines into a block to sample image signals. The difference of brightness of an image data Vid6 to be provided to the data line arranged at one side of the block is obtained, and a correction data V1 corresponding to the difference of brightness is added to an image data Vid1 to be provided to the data line arranged at the other end of the block.

15 Claims, 11 Drawing Sheets

IMAGE SIGNAL CORRECTION METHOD, CORRECTION CIRCUIT, ELECTRO-OPTICAL DEVICE, AND ELECTRONIC APPARATUS

BACKGROUND

The present invention relates to a technology for suppressing degradation of a display quality when a plurality of data lines is driven in group.

For display panels that perform display by the electro-optical change of an electro-optical material, e.g., liquid crystal display panels using a liquid crystal can be classified into several categories based on a driving scheme. However, for an active matrix driving a pixel electrode with a three terminal type switching device, the following arrangement is typically used. Specifically, in this type of liquid crystal panel, a liquid crystal is interposed between a pair of substrates, and a plurality of scanning lines 112 are arranged to intersect a plurality of data lines 114 on one substrate, as shown in FIG. 7. In addition, thin film transistors 116 (hereinafter, referred to as TFT) and pixel electrodes 118 are arranged on one substrate at the corresponding respective intersections of the scanning lines 112 and the data lines 114. Further, transparent counter electrodes 108 (common electrodes) maintained at a constant voltage LCcom are arranged to face the pixel electrode 118 on the other substrate, and TN liquid crystals 105 are interposed between two electrodes. For this reason, a liquid crystal capacitor comprising the pixel electrode 118, the counter electrode 108 and the liquid crystal 105 is provided for each pixel.

In addition, on each facing surface of both substrates, a rubbing processed alignment film (not shown) is arranged such that a long axis direction of the liquid crystal molecule is consecutively tilted, for example, about 90 degrees between both substrates, while a polarizer is arranged on each of opposition side of both substrates according to the alignment direction.

In addition, to prevent the charge leakage in the liquid crystal capacitor, a storage capacitor 119 is arranged for each pixel. One end of the storage capacitor 119 is connected to a pixel electrode 118 (a drain of TFT 116), while the other end is commonly grounded to potential Gnd throughout entire pixels. According to the present embodiment, the other end of the storage capacitor 119 is grounded to potential Gnd, it may be applied to a predetermined potential (e.g., voltage LCcom, a high level power supply voltage of the driving circuit, or a low level power supply voltage of the driving circuit, etc.).

For convenience, assuming that a total number of scanning lines 112 is 'm', a total number of data lines 114 is '6n', (where, m and n are integers, respectively), pixels are arranged in a matrix of m row×6n column corresponding to each intersection located between the scanning lines 112 and the data lines 114.

A light transmitting between the pixel electrode 118 and the counter electrode 108 is refracted about 90 degrees along with the tilt of the liquid crystal when an effective voltage of the liquid crystal capacitor is zero, while as the effective voltage grows larger, the liquid crystal molecule is tilted toward the electric field. Therefore, its optical activity is lost. For this reason, in the transmission type, for example, in case that a polarizer whose polarizing axis is perpendicular to each other to match the alignment direction is arranged at each incident side the bottom side (in a normally white mode), when the effective voltage of the liquid crystal capacitor is zero, light is transmitted to perform a white display (large transmittance), while as the effective voltage becomes larger, the amount of transmitted light is reduced to perform a black display (smallest transmittance). Therefore, when the TFT 116 is turned on by selecting each one of the scanning lines 112, the image signal of the voltage corresponding to a gray scale level (or brightness) of the pixel is applied to the pixel electrode 118 via the data line 114, such that the effective voltage of the liquid crystal capacitor can be controlled for each pixel. Further, the predetermined display is enabled based on this control.

Here, although the liquid crystal panel can be used as a light valve such as a projector. However, the projector does not have any function to make images in its own, and thus it receives an image signal from the upper level apparatus such as a PC or a television tuner. The image signal is provided in a manner of horizontally and vertically scanning images arranged in a matrix. Therefore, for the liquid crystal panel used for the projector, it is appropriate to meet this specification. Accordingly, for the liquid crystal panel used for the projector, a method of point-sequential driving is employed as a driving scheme to provide the image signal to the data line 114. In the method of point-sequential driving, an image signal transformed from a video signal to be adapted to the liquid crystal driving is sampled to the data line for one data line 114, during a period one scanning line 112 is selected (one horizontal effective scanning period).

In addition, recently, there is a strong need for a high definition such as Hi-Vision. The high definition can be accomplished by increasing the number of scanning lines 112 and the data lines 114. However, as the number of scanning lines 112 increases, the horizontal scanning period is shortened. Moreover, with a point-sequential method, as the number of data lines 114 increases, the sampling time to the data line 114 is also reduced. Likewise, in case of the high definition, with the point-sequential method, the sampling time to the data line 114 is not sufficiently secured for the image signal, such that a phase expansion driving method as shown in FIG. 8 is employed. In the phase expansion driving method, while the arrangement in the display region 110*a* are not changed from that of FIG. 7, the data lines 114 are blocked for every predetermined number (e.g., 6) and the image signal is distributed into 6 channels corresponding to the number of the data lines 114 included in one block. In addition, the image signal is expanded 6 times longer in the time axis, and thus provided to the image signal line 171 as image signals Vid1 to Vid6.

Further, to one end of the data line 114 arranged leftmost among 6 data lines 114 belonging to the i-th row block (where, i is 1, 2, . . . , n) counting from the left side in FIG. 8, a drain of an N channel TFT 151 is connected as a sampling switch, while a source thereof is connected to the image signal 171 to which the image signal Vid1 is provided. Likewise, to one end of the data line 114 arranged at second, third, . . . , sixth row counting from the left side of the corresponding block, drains of the corresponding TFTs 151 are connected, while sources thereof are connected to the image signal line 171 to which the image signals Vid2, Vid3, . . . , Vid6 are provided.

In addition, in FIG. 8, a scanning line driving circuit 130 outputs scanning signals G1, G2, G3, . . . , and Gm, which sequentially and exclusively come to be an H level, by means of a clock signal CLY or a start pulse DY within one vertical effective scanning period. Further, a shift register 140 outputs sampling signals S1, S2, S3, . . . , and Sn, which sequentially and exclusively come to be an H level, by means of a clock signal CLX or a start pulse DX within one horizontal effective scanning period.

In the phase expansion driving, each block is selectively one by one within the one horizontal effective scanning period, by sampling signals S1, S2, S3, . . . , and Sn. Here, for example, when an i-th row block is selected, i.e., a sampling signal Si comes to be an H level, 6 TFTs 151 where drains are connected to the data lines 114 belonging to the related block are simultaneously turned on. Therefore, for each of the first, second, third, . . . , and sixth row data lines 114 belonging to the related block, each of the image signals Vid1, Vid2, Vid3, . . . , and Vid6 is sampled.

In the phase expansion driving, compared to the arrangement where the image signal is sampled by selecting the data lines 114 one by one, the time required in sampling can be made 6 times longer. Therefore, the phase expansion driving can be used to achieve high definition, as described above. Furthermore, while the number of data lines contained in one block is assumed to be 6, this is just illustrative, and thus the present invention is not limited hereto.

However, in the phase expansion driving, since the plurality of data lines 114 are grouped and driven in blocks, a so-called block irregularity representing that brightness of the pixels are different for each block is produced. Regarding this, the present invention proposes a technology for make the block irregularity unnoticeable by making correction signals based on the difference between the image signals of the respective channels and the reference signal to add the correction signal to the respective channels.

SUMMARY

With the above-mentioned technology, the block irregularity can be suppressed more or less while another type of vertical alignment irregularity becomes noticeable. This type of irregularity refers to a phenomenon that all of the pixels A to F in the (i−1)th row block are set to be an intermediated gray scale level between a lowest gray scale level or a black color, and a highest gray scale level or a white color, for example, as shown in FIG. 9A, and although the pixel A arranged at the end of a side opposite to the horizontal scanning direction among the next i-th row block is intended to show a different brightness (e.g., black color) from those of the pixels B to F, in fact, the pixel F arranged opposite to the pixel A in the i-th row block shows different brightness from those of the pixels B to E, which should show the same brightness.

The present invention has been made in consideration of the above-mentioned situations, and an object of the present invention is to provide an image signal correction method, correction circuit, an electro-optical device, and an electronic apparatus using the electro-optical device as a display unit, in which the above type of display irregularity is suppressed to enable a higher quality display.

First, a cause of the display irregularity will be described. FIG. 10 is a plan view showing an arrangement of a circuit around an image signal line 171, a TFT 151 and a data line 114, and FIG. 11 is a diagram showing an equivalent circuit thereof. As shown in FIG. 10, a drain of a certain TFT 151, i.e., the data line 114 is close to a source of the rightward adjacent TFT 151. For this reason, both are connected via a parasitic capacitor as a dotted line of FIG. 11.

Accordingly, some data line 114 is capacitively coupled to the image signal line 171 where the image signal larger by 1 than the channel of the image signal essentially provided to the related data line. For example, the data line 114 arranged at the third row counting from the left side of the block is coupled to the image signal line 171 where the image signal Vid4 is supplied by a capacitor C3. However, exceptionally, for the sixth row data line 114 arranged at the rightmost end of each block is coupled to the image signal line 171 which is a minimum channel where the image signal Vid1 is supplied, via a capacitor C6.

Here, a case where the image is to be displayed as shown in FIG. 9 will be described. In addition, since an alternative current driving is basically used in a liquid crystal, it is necessary to invert writing polarity for each predetermined period, from a point of one pixel. Polarity inversion can be performed as follows: (1) for each scanning line (2) for each data signal line, and (3) for each pixel. However, for convenience, the polarity inversion in the case of (1) for each scanning line are used herein, and a period of the polarity inversion is set to be 1 vertical scanning period. In addition, the polarity inversion herein refers to an alternative inversion of a voltage level using a predetermined constant voltage Vc (amplitude centered potential of the image signal, which is approximately same as a voltage LCcom applied to the counter electrode) as a reference. Further, a writing that applies a higher voltage than the voltage Vc to the pixel electrode is referred to as a positive write, while a writing that applies a lower voltage than the voltage Vc to the pixel electrode is referred to as a negative write.

During the corresponding one horizontal effective scanning period, the sampling signals S1, S2, S3, . . . , and Sn sequentially and exclusively come to be an H level. In FIG. 12, among these, the sampling signals S(i−1), Si are illustrated.

6 pixels arranged at intersections located between selected scanning lines and the data lines 114 belonging to the (i−1)th row block are gray colors with the same intermediate gray scale level. For this reason, when the (i−1)th row block is selected, all of the image signals Vid1 to Vid6 are in the same voltage corresponding to the related gray color.

Next, among the 6 pixels arranged at intersections located between the selected scanning lines and the data lines 114 belonging to the i-th row block, the pixels B to F are gray colors with the same gray scale level, and only the left end of the pixel A is black color. Therefore, when the i-th row block is selected, all of the image signals Vid2 to Vid6 are in the voltage corresponding to the gray color, such that which are not changed compared to a case where the (i−1)th row block is selected, but the image signal Vid1 is in the voltage corresponding to the black color, which is changed from the case where the (i−1)th row block is selected.

Specifically, when the positive write is performed in the corresponding one horizontal effective scanning period, the image signal Vid1 is raised from the time when the (i−1)th row block is selected to the time when the i-th row block is selected, as indicated by a solid line of FIG. 12. In addition, when the negative write is performed in the corresponding one horizontal effective scanning period, the image signal is fallen as indicated by a dotted line of FIG. 12.

Here, the other ends of the parasitic capacitors C2 to C5 on the second to fifth row data lines 114 counting from the left side of the i-th row block are Vid3 to Vid6, i.e., the voltages corresponding to the gray color that does not changed from the time when the (i−1)th row block is selected. However, the other end of the parasitic capacitor C6 on the data line 114 arranged at the rightmost end of the i-th row block is the image signal Vid1, i.e., the voltage corresponding to the black color changed from the time when the (i−1)th row block is selected.

Accordingly, compared to the second to fifth row data lines 114, the voltage at the other end of the capacitor C6 is changed larger than the voltage at the other ends of the capacitor C2 to C5, such that the voltage corresponding to the gray color is sampled in the data line 114 arranged at the rightmost end of the i-th row block. In other words, in all of the second to fifth row data lines 114 of the i-th row block, the voltages corresponding to the gray color are sampled, however, only the sixth row data line 114 of the i-th row block is raised (positive write) contrary to the others.

Therefore, the effective voltage applied to the pixel through the sixth row data line 114 arranged at the rightmost end of the i-th row block is smaller than the effective voltage applied to the pixel through the second to fifth row data lines 114. For this reason, compared to the second to fifth row pixels B to E, it will be noted that the pixel F arranged at the rightmost end of the i-th row block becomes brighter a little bit in the normal white mode. When the symmetry with reference to the voltage Vc is considered, it will be appreciated that this can be applied to either the positive write or the negative write.

In addition, although the example where the first row pixel A at the leftmost end of the block is changed into the black color has been described, the same phenomenon also occurs even when the sixth row pixel F at the rightmost end of the block is changed into the black color. More specifically, since the capacitor C6 is interposed between the sixth row data line arranged at the rightmost end of the block and the image signal line 171 to which the image signal Vid1 is provided, the voltage change of the related data line 114 when the i-th row block is selected, changes the effective voltage applied to the pixel through the first row data line 114 of the same block due to the same reason. Therefore, as shown in FIG. 9, the first row pixel A of the i-th row block becomes slightly brighter than the second to fifth row pixels B to E.

In addition, since the capacitor C1 is interposed between the first row data line 114 at the leftmost end of the block and the image signal line 171 to which the image signal Vid2 is provided, the voltage change of the related data line 114 when the i-th row block is selected, changes the effective voltage applied to the pixel through the second row data line 114 of the same block due to the same reason. Therefore, as shown in FIG. 9C, the second row pixel B of the same block becomes a little bit brighter than the third to fifth row pixels. However, the pixel A adjacent to the second row pixel B, i.e., the first row pixel A arranged at the leftmost end of the i-th row block is black, and the others are noticeable and have different brightness, such that the second row pixel B becomes a little bit brighter than the third to fifth row pixels C to E. However, since it is not as distinguishable as the sixth row pixel F, the present invention disregards the above situations.

Likewise, for one horizontal effective scanning period, in case that brightness of the pixel is not changed on the way, or in case that the change is small, when brightness of the pixel arranged at one end of a certain block is changed, brightness of a pixel arranged opposite to the block is changed according to the above change.

Here, according to an aspect of the present invention, there is provided a method of correcting an image signal of an electro-optical panel. The electro-optical panel comprises a plurality of scanning lines, a plurality of data lines grouped in blocks each having a predetermined number of data lines, a predetermined number of image signal lines for supplying sampled image signals to the predetermined number of data lines belonging to a selected block, respectively, when the blocks are sequentially selected, a plurality of sampling switches interposed between the data lines and the image signal lines, for sampling the image signals supplied from the image signal lines to the data lines, and a plurality of pixels arranged at intersections of the scanning lines and the data lines, into which the image signal supplied from the corresponding data lines are written. The method comprises a step of obtaining the difference between brightness indicated by the image signal supplied to a first data lines arranged at one end of the block and brightness indicated by an image signal supplied to a second data line arranged at one end of a second block, and a step of correcting an image signal supplied to a third data line arranged at the other end of the second block using a correction signal obtained from the difference of brightness.

Specifically, the image signal is corrected in advance to suppress the above-mentioned display irregularity and then provided to the electro-optical panel.

Further, in the image signal correction method, according to another aspect of the present invention, there are provided a correction circuit and an electro-optical device itself. Furthermore, there is also provided an electronic apparatus, which comprises the electro-optical device as a display unit.

DETAILED DESCRIPTION OF EMBODIMENTS

The exemplary embodiments will now be described with reference to the accompanying drawings.

First Embodiment

Figure 1:
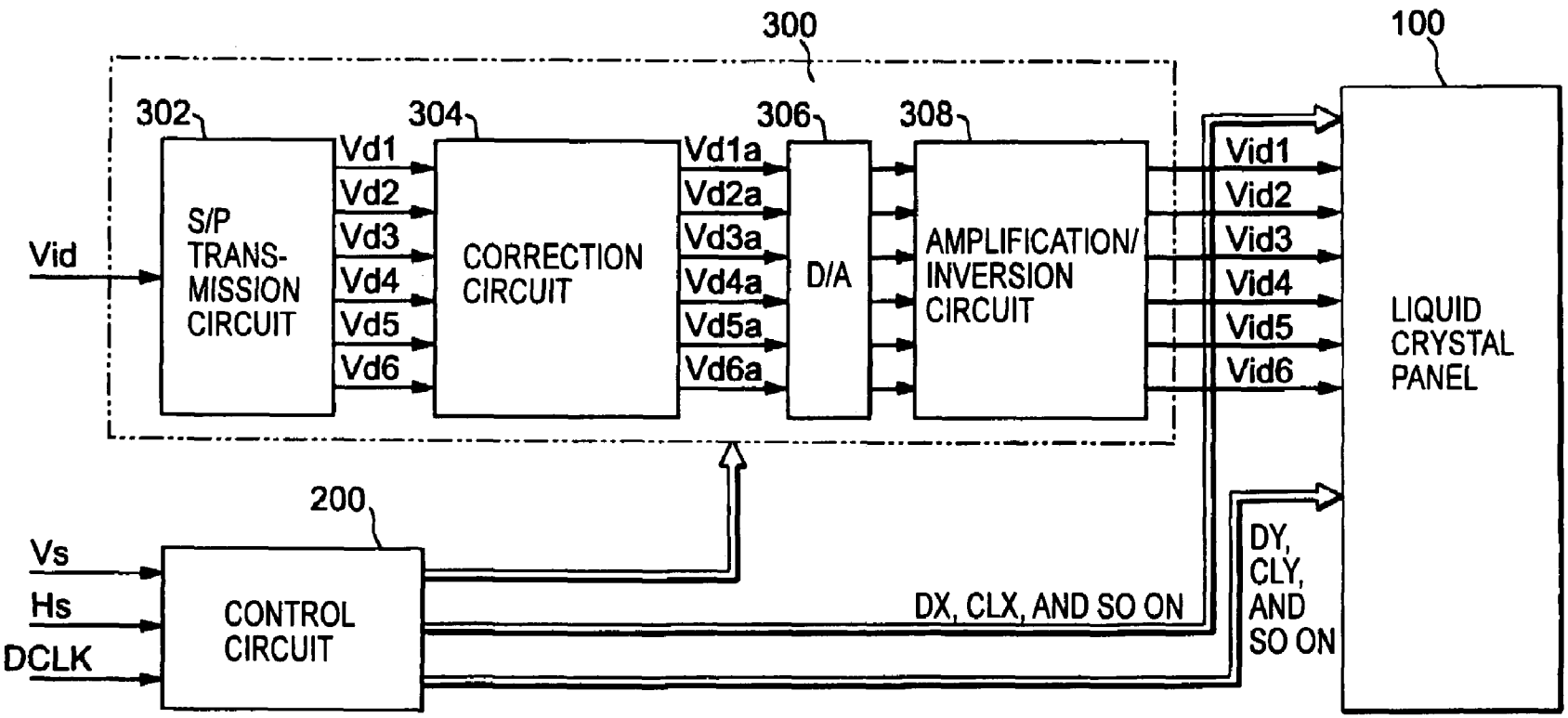
FIG. 1 is a block diagram showing an overall arrangement of an electro-optical device according to a first embodiment of the present invention.

FIG. 1 is a block diagram showing an overall arrangement of an electro-optical device comprising a correction circuit according to a first embodiment of the present invention.

As shown in FIG. 1, the electro-optical device comprises a liquid crystal panel 100, a control circuit 200, and a processing circuit 300. Among these, the control circuit 200 generates a timing signal or a clock signal and the like to control respective units according to a vertical scanning signal Vs, a horizontal scanning signal Hs and a dot clock signal DCLK supplied from the upper level apparatus which is not shown. Further, the processing circuit 300 comprises an S/P conversion circuit 302, a correction circuit 304, a D/A converter 306, and an amplifying/inverting circuit 308.

The S/P conversion circuit 304 distributes the digital image data Vid provided to N (here, N=6) system in serial from an upper level device not shown in synchronization with the vertical scanning signal Vs, the horizontal scanning signal Hs and the dot clock signal DCLK, i.e., in synchronization with the vertical scanning and the horizontal scanning, and expands N times in a time-axis (serial-parallel conversion) to output as image data Vd1 to Vd6. The correction circuit 302 corrects the image data Vd1 to Vd6 to output as the corrected image data Vd1*a* to Vd6*a*, respectively. In addition, the correction circuit 302 herein will be described in more detail.

The D/A converter 306 coverts the corrected image data Vid1*a* to Vid6*a* into analog image signals, respectively. The amplifying/inverting circuit 308 inverts signals of which the polarity inversion is required, among the converted analog image signals, and then, amplifies the signals to output to the liquid crystal panel 100 as the image signals Vid1 to Vid6. Here, the polarity inversion refers to a polarity inversion in the scanning unit as described above.

Figure 2:
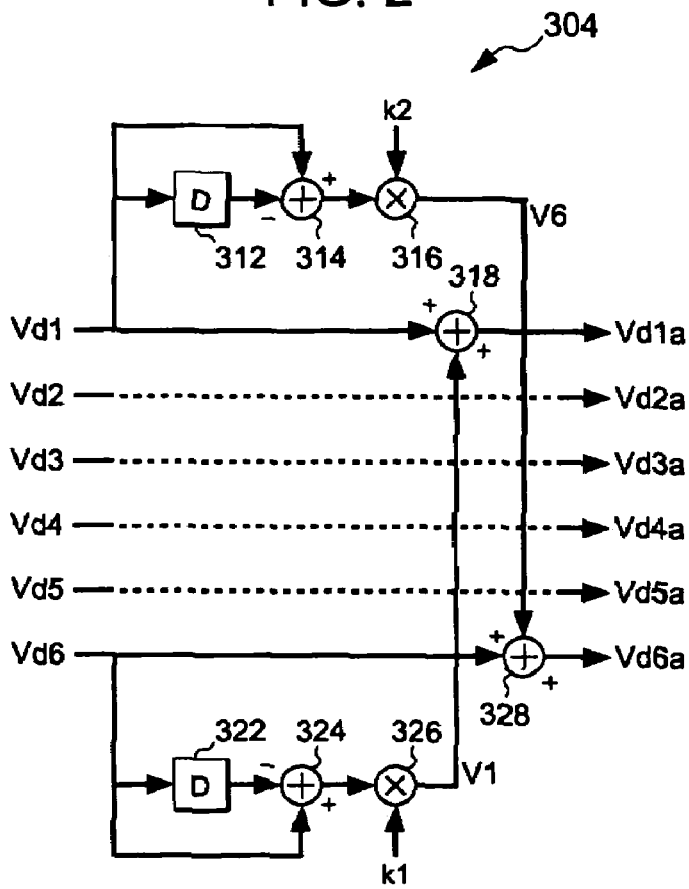
FIG. 2 is a block diagram showing an arrangement of a correction circuit of the electro-optical device according to the first embodiment of the present invention.

FIG. 2 is a block diagram showing a detailed arrangement of the correction circuit 304. As shown in FIG. 2, among the image data Vd1 to Vd6, the image data Vd2 to Vd5 is output as the corrected image data Vd2*a* to Vd5*a*, as it is.

Further, the image data Vd1 is provided to an input terminal of a delay device 312, an addition input terminal of a subtracter 314 and an addition input terminal of an adder 318, respectively. In addition, the image data Vd6 is provided to an input terminal of a delay device 322, an addition input terminal of a subtracter 324, and an addition input terminal of an adder 328.

The delay device 312 delays a time required for selecting one block, such that the image data Vd1 input when the (i−1)th row block is selected is output when the next i-th row block is selected. The subtracter 314 subtracts an output of the delay device 312 from the image data Vd1 of the current stage. For this reason, the subtraction result of the subtracter 314 represents the difference of brightness of a pixel designated as the image data Vd1, from the time when the (i−1)th row block is selected to the time when i-th row block is selected. This subtraction result is multiplied by a coefficient k2 by a multiplier 316 and provided to the addition input terminal of the adder 328 as the correction data V6. In addition, the correction data V6 is added to the image data Vd6 by the adder 328, such that the corrected image data Vd6*a* is output.

Figure 9A:
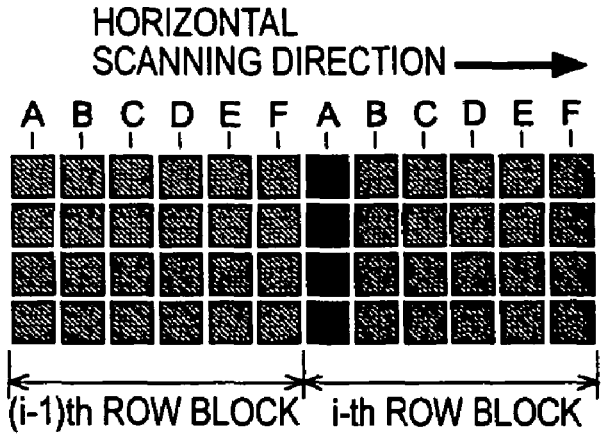
FIG. 9 is a diagram showing a display irregularity of the phase expansion driving.
Figure 9B:
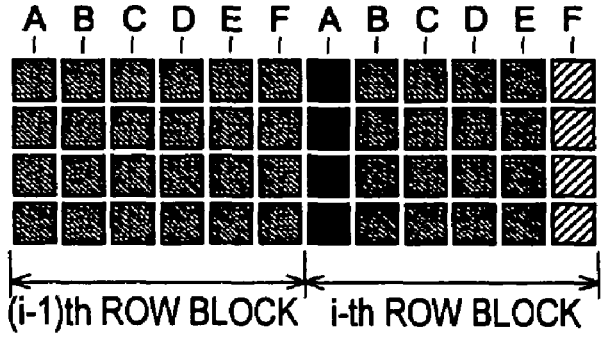
Figure 9C:
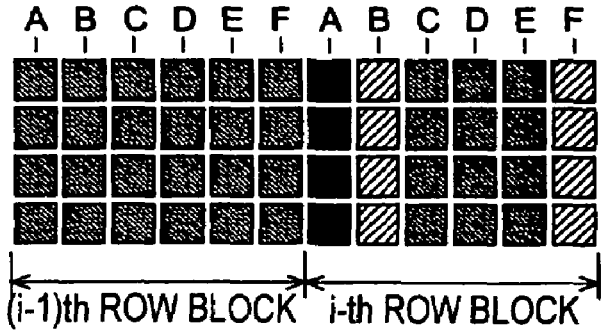

Therefore, the corrected image data Vd6*a* corrects the original image data Vd6 according to the difference of brightness of the pixel for the image data Vd1, thereby suppressing a phenomenon that brightness change of the pixel A changes brightness of the pixel F (refer to FIG. 9B). Therefore, the gray color can be displayed with the same brightness as that of other pixels C to E.

In the same manner, the delay device 322 delays a time required for selecting one block, such that, for example, the image data Vd6 input when the (i−1)th row block is selected is output when the next i-th row block is selected. The subtracter 324 subtracts an output of the delay device 322 from the image data Vd6 of the current stage. For this reason, the subtraction result of the subtracter 324 represents the difference of brightness of a pixel designated to the image data Vd6, from the time when the (i−1)th row block is selected to the time when i-th row block is selected. This subtraction result is multiplied by a coefficient k1 by a multiplier 326 and supplied to the addition input terminal of the adder 318 as correction data V1. In addition, the correction data V1 is added to the image data Vd1 by the adder 318, such that the corrected image data Vd1*a* is output.

Figure 9D:
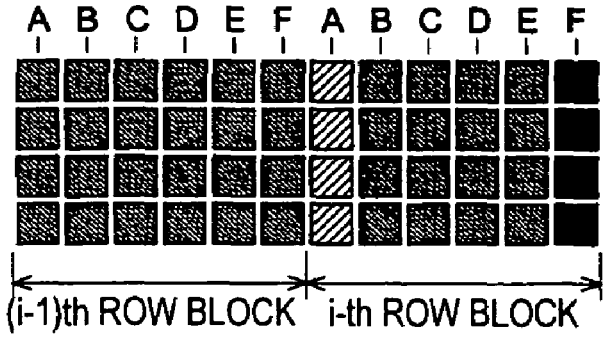

Therefore, the corrected image data Vd1 a corrects the original image data Vd1 according to the difference of brightness of the pixel for the image data Vd6, thereby suppressing a phenomenon that the change of brightness of the pixel F changes brightness of the pixel A (refer to FIG. 9D). Therefore, the gray color can be displayed in the same brightness as that of other pixels C to E.

Second Embodiment

As described below, for a projector comprising a liquid crystal panel 100, a three-plate method that combines RGB primary color images with a dichroic prism is used. In the dichroic prism, for example, the R and G primary colors are reflected and the B primary color is transmitted, such that images by the R and G liquid crystal panel 100 need a horizontal inversion with respect to the image by the B liquid crystal panel 100. In addition, when the projector is suspended from the ceiling, the transmissive images need a vertical and horizontal inversion compared to a case where the projector is placed on the table.

Therefore, the liquid crystal panel 100 needs to have an exchangeable arrangement between a normal rotational direction from the left to the right and a reverse rotational direction from the right to the left.

Figure 3:
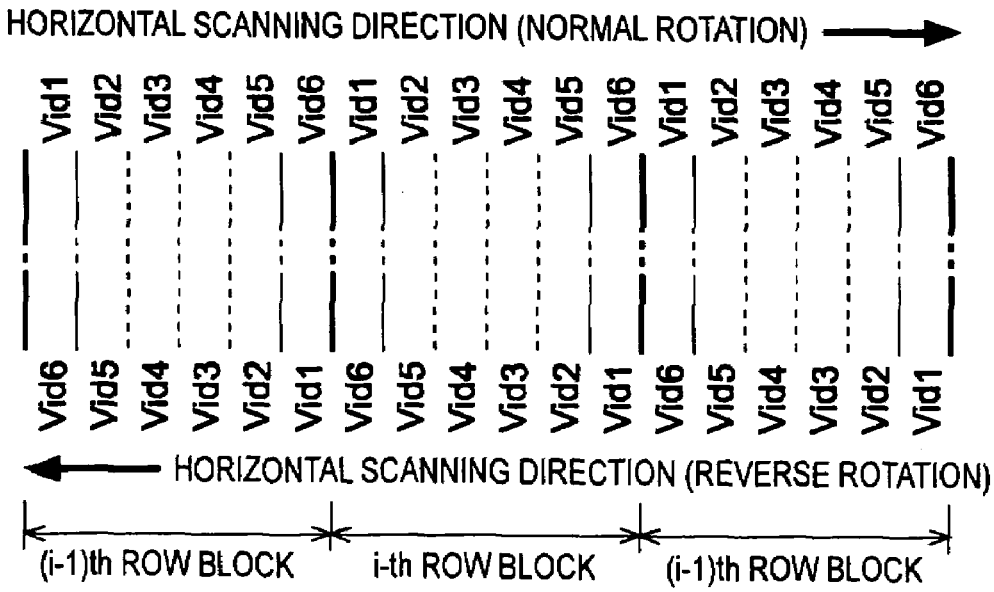
FIG. 3 is a diagram showing a horizontal scanning direction of the electro-optical device according to the first embodiment of the present invention.

To make a horizontally inverted image by the liquid crystal panel 100, it is not sufficient that a shift register 140 sequentially outputs the sampling signal Sn to S1. Thus, the corresponding relationship of the channel in the image signal line 171 should be also inverted. For this reason, the S/P conversion circuit 302 changes an order of the distribution. Thus, for the respective block, the corresponding relationship to the image signal line 171 is inverted such that the state where the image signals Vid1 to Vid6 are provided from the left to the right is changed into the state where the image signals are provided from the right to the left, as shown in FIG. 3. Further, for the correction circuit 304, it has been found that the image data Vd1 (Vd6) is preferably corrected according to the difference of brightness from the time when the next block is selected for the image data Vd6 (Vd1) to the time when the focused block is selected.

Furthermore, strictly speaking, the image data supplied at the time of selecting the next block is a future temporally. Thus, according to the following embodiment, the image data supplied at the current stage are used as the image data supplied when the next block is selected, and the delayed image data are used as image data provided when the focused block is selected.

According to the second embodiment of the present invention, the correction circuit 304 for a case where the horizontal scanning direction is inverted will be described with reference to FIG. 4. In addition, in FIG. 4, the order of the image data Vd1 to Vd6 is reversed compared to that of FIG. 2, due to the relation of the image signal line 171 as described above.

Figure 4:
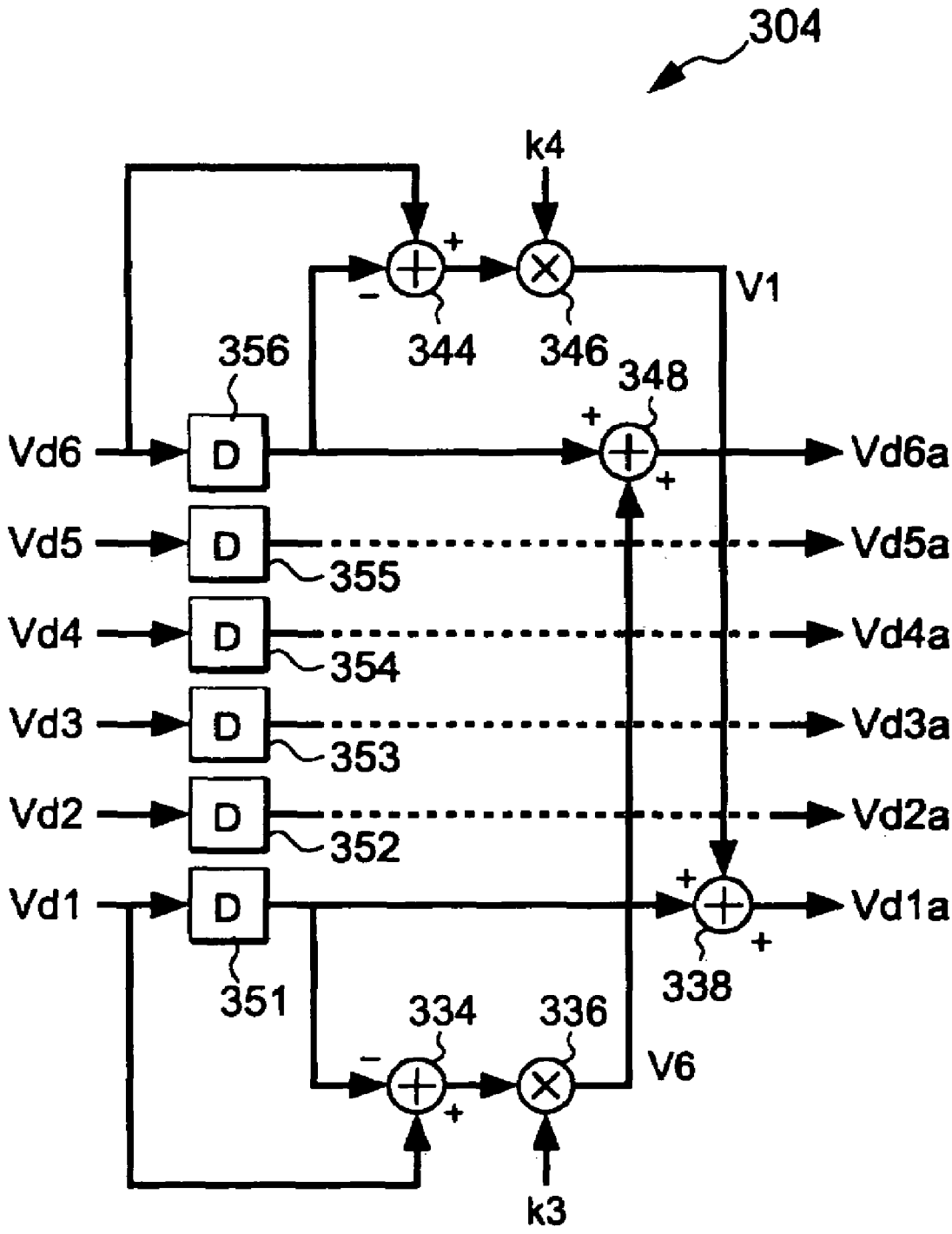
FIG. 4 is a block diagram showing an arrangement of a correction circuit of the electro-optical device according to the second embodiment of the present invention.
Figure 5:
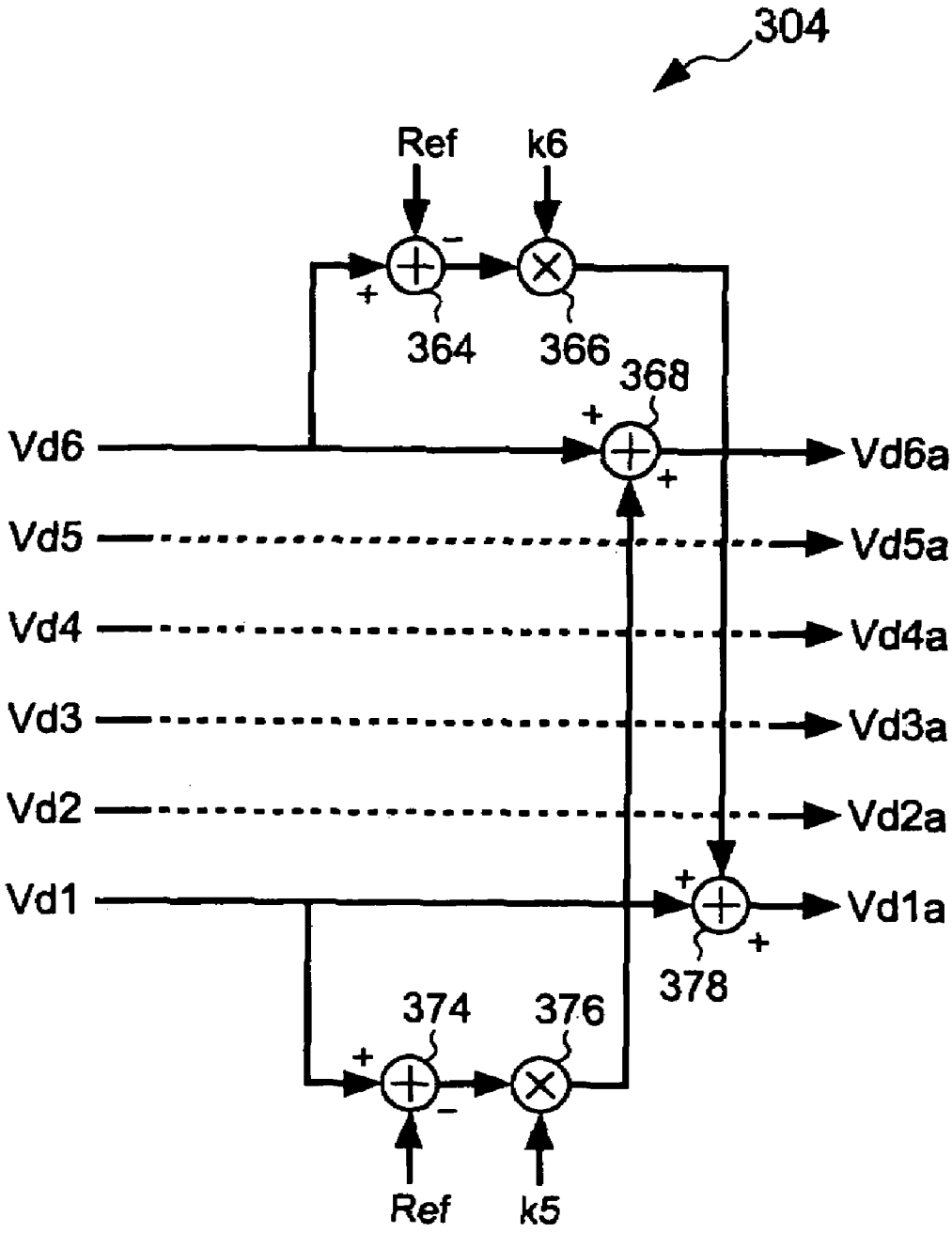
FIG. 5 is a block diagram showing a modification of an arrangement of a correction circuit of the electro-optical device according to the present invention.

As shown FIG. 4, among the image data Vd1 to Vd6, the image data Vd2 to Vd5 are delayed by a time just for selecting one block, through the delay device 352 to 355 respectively, and are output as Vd2*a* to Vd5*a*. Additionally, in the present embodiment, the reason why each of the image data Vid1 to Vid6 is delayed by the delay device 351 to 356 is that the delayed image data are provided when the noted block is selected.

Further, the image data Vd6 is provided to the input terminal of the delay device 356 and the addition input terminal of the subtracter 344, respectively. The image data input to the delay device 356 is delayed by the time just for selecting the one block and provided to the subtraction input terminal of the subtracter 344 and the input terminal of the adder 348, respectively.

In the same manner, the image data Vd1 is provided to the input terminal of the delay device 351 and the addition input terminal of the subtracter 334, respectively. The image data Vd1 input to the delay device 351 is delayed by the time required for selecting one block, and provided to the subtraction input terminal of the subtracter 334 and the input terminal of the adder 338. The subtracter 334 subtracts the output of the delay device 351 from the image data Vd1 provided at the current stage. For this reason, the subtraction result of the subtracter 334 represents the difference of brightness of the pixel designated by the image data Vd1 from the time when the i-th row block is selected to the time when the (i−1)th row block is selected. This subtraction result is multiplied by a coefficient k3 by the multiplier 336, and then, provided to the addition input terminal of the adder 348 as a correction data V6. The correction data V6 is added to the image data Vd6 delayed by the delay device 356, by the adder 348, and output as corrected image data Vd6*a*.

In the same manner, the subtracter 344 subtracts the output of the delay device 356 from the image data Vd6 provided at the current stage. For this reason, the subtraction result of the subtracter 344 represents the difference of brightness designated by the image data Vd6 from the time when the i-th row block is selected to the time when the (i−1)th row block is selected. This subtraction result is multiplied by a coefficient k4 by the multiplier 346, and then provided to the addition input terminal of the adder 338. Further, the corrected data V1 is added to the image data Vd1 delayed by the delay device 351, by the adder 338, and output as corrected image data Vd1*a*.

According to the second embodiment, for a case where the horizontal scanning direction is inverted, the display irregularity can be suppressed as in the case where the horizontal scanning direction is in normal rotation, in the same manner with the first embodiment.

Application

Further, although the difference of brightness of the pixel represented by the image data is obtained in the arrangement using the delay device and the subtracter, in the first and second embodiments, another arrangement can also be used where the difference between brightness represented by the image data Vid6 (Vid1) and brightness represented by the reference signal Ref is obtained by the subtracter 364 (374) and the difference is multiplied by the coefficient k6 (k5) by the multiplier 366 (376) and added to the image data Vid1 (Vid6) as the corrected data V1 (V6) by the adder 378 (368).

Figure 10:
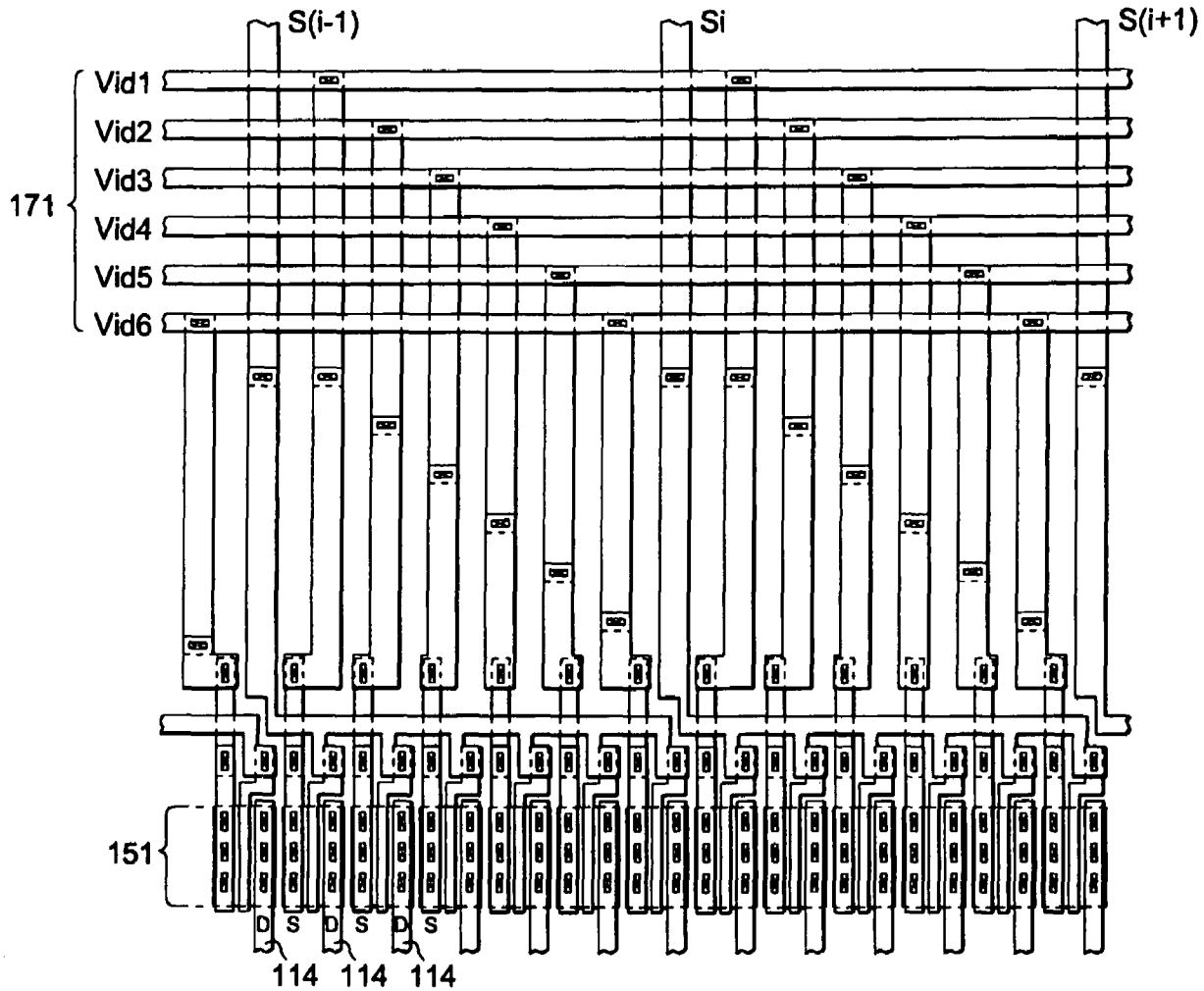
FIG. 10 is a plan view showing an arrangement of a phase expansion driving circuit.
Figure 11:
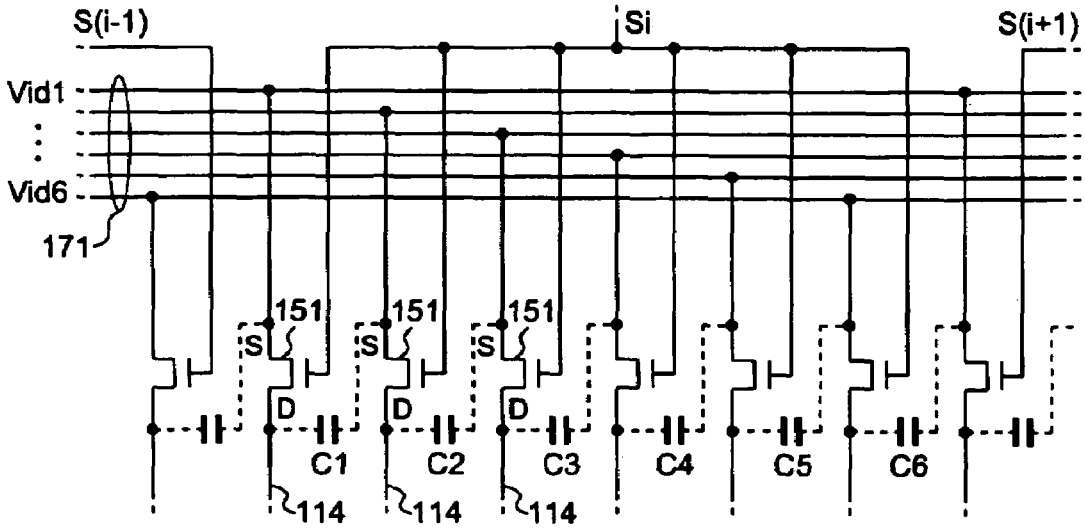
FIG. 11 is an equivalent circuit diagram showing an arrangement of a phase expansion driving circuit.
Figure 12:
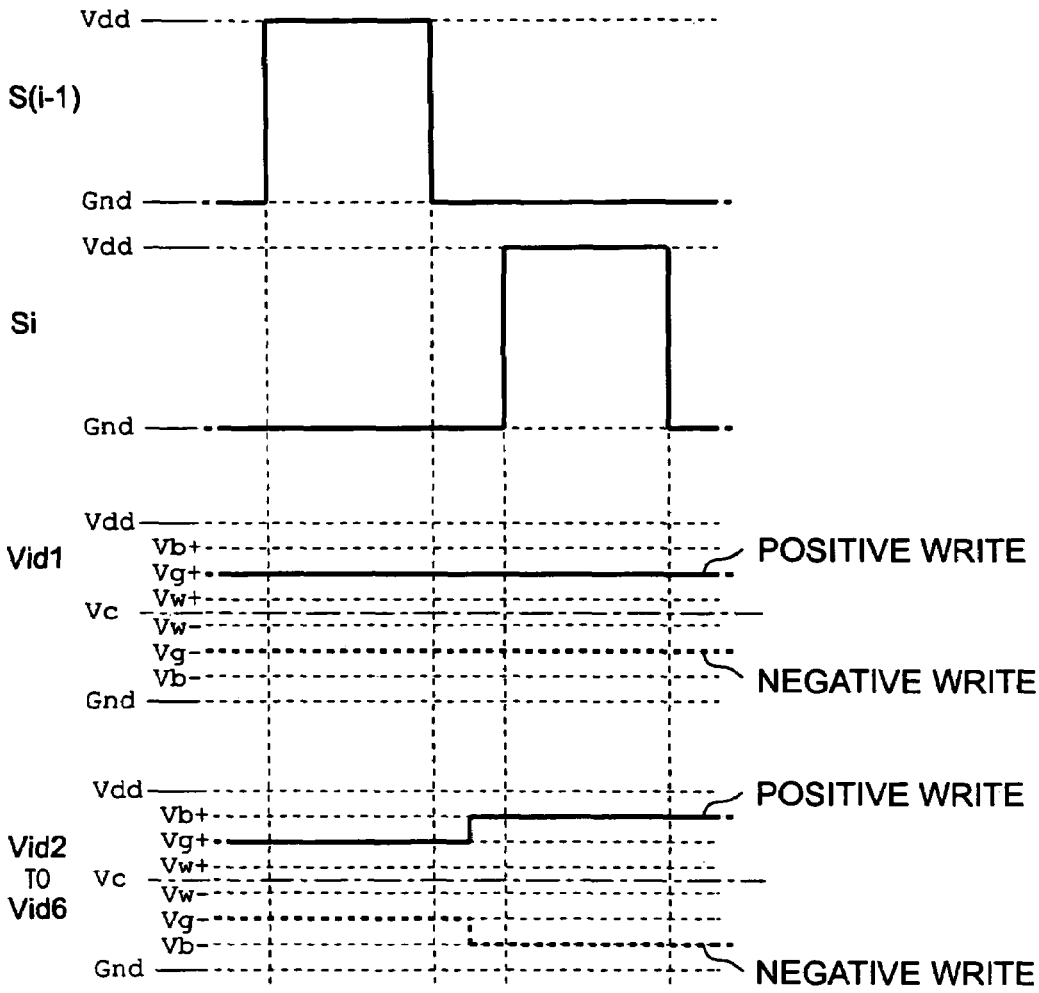
FIG. 12 is a timing chart for explaining an operation of a phase expansion driving.

In addition, in the above-mentioned embodiments, although a circuit layout around the image signal line 171, the TFT 151 and the data line 114 is based on the arrangement shown in FIG. 10, or the arrangement where the drain (data line 114) of the certain TFT 151 is close to the source of the TFT 151 adjacent rightward in the direction, other layouts can also be used where the source drain is arranged opposite to that of the above-mentioned embodiments. In other words, the arrangement where a drain (data line 114) of the certain TFT 151 is close to a source of the TFT 151 adjacent leftward in the direction can also be used. However, in any of the above arrangement, the fact that the voltage change of the image signal for the pixel arranged at one end of the block changes the effective voltage for the pixel arranged at the other end of the block is not changed. Therefore, the source and the drain of the TFT 151 can be placed opposite to the above embodiments.

Although the converted image signals Vid1 to Vid6 in the 6 channels are sampled for the 6 data lines 114 grouped in one block, the number of channels and the number of data lines applied at the same time (i.e., the number of data lines grouped in a group) are not limited to '6', and can also be '2' or more. For example, the number of channels and the number of data lines applied at the same time are '3', '12', and '24' so that the corrected image signals distributed into 3, 12, and 24 channels can be provided to 3, 12, and 24 data lines. In addition, the number of channels is preferably a multiple of '3' to simplify the control or circuit and the like, due to the relation consisting of the signals related to the 3 primary colors. However, in case for a use of simple optical modulation such as a projector as described below, it is not necessarily the multiple of '3'.

Further, although the processing circuit 300 processes the digital image signal Vid in the above-mentioned embodiments, the processing circuit 300 may process an analog image signal. Furthermore, although the above-mentioned embodiments has been described with reference to the normally white mode where the white display is performed when the effective voltage of the pixel electrode 118 and the counter electrode 108 are small, a normally black mode performing a black display can also be used.

In addition, although the TN liquid crystal is used in the above-mentioned embodiments, there may be used a bi-stable type that has a memory capacity such as BTN (Bi-stable Twisted Nematic, a ferroelectric type and a polymer dispersion type, or a GH (guest-host) type that arranges a dye molecule in parallel with the liquid crystal molecular by dissolving the dye (guest) having anisotropy for a visible light absorption in the long axis direction and the short axis direction of the molecular to a liquid crystal (host) with the constant molecular arrangement.

In addition, a vertical alignment (homeotropic alignment) where, when the voltage is not applied, the liquid crystal molecule is arranged perpendicular to both substrates, while when the voltage is applied, the liquid crystal molecule is arranged parallel to the both substrate can be used. Alternatively, and a parallel alignment (homogeneous alignment) where, when the voltage is not applied, the liquid crystal molecule is arranged parallel to both substrate, while when the voltage is applied, the liquid crystal molecule is arranged perpendicular to both substrates can also be used. Accordingly, the present invention may use various types of liquid crystals and alignment methods.

Although the above embodiments have been described with reference to the liquid crystal device, only if a predetermined number of data lines are blocked and the image signal provided to the corresponding image signal line is sampled to each of the data line belonging to the selected block, the present invention can be applied to a device using an electronic luminescence device, a field emission device, an electrophoresis device, and a digital mirror device, or a plasma display.

Electronic Apparatus

Next, as an example of an electronic apparatus using an electro-optical device according to the above-mentioned embodiments, a projector that uses the above-mentioned liquid crystal panel 100 as a light valve will be described.

Figure 6:
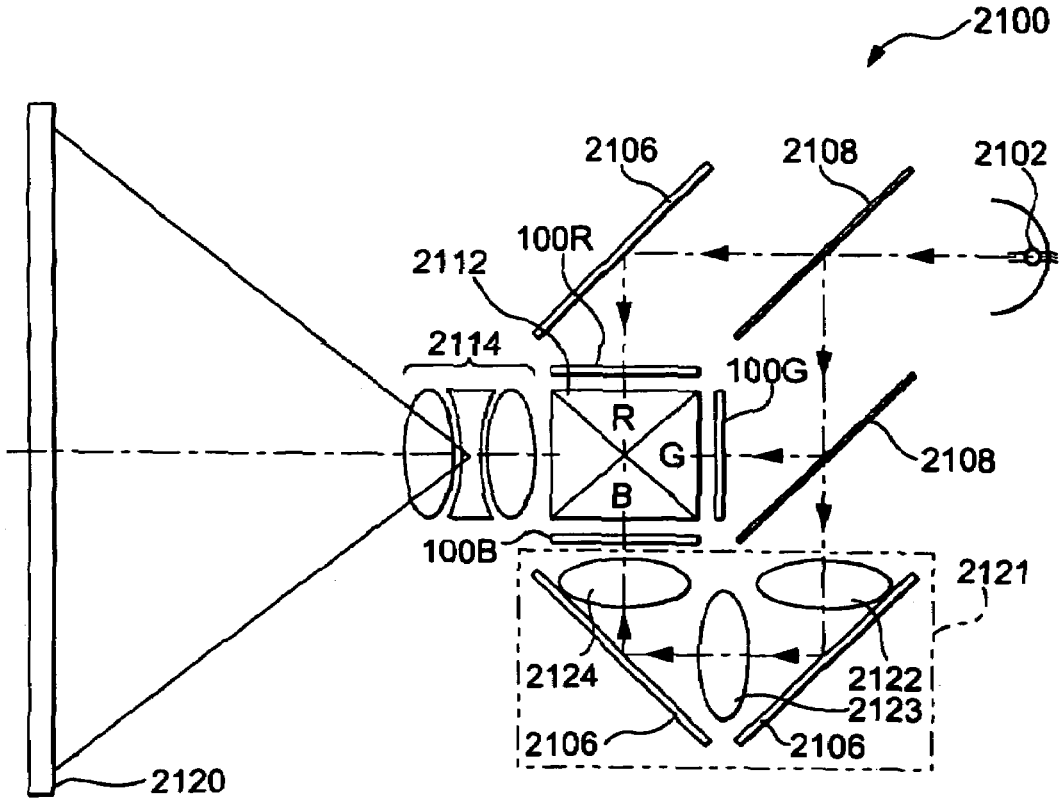
FIG. 6 is a cross-sectional view showing an example of an arrangement of an electronic apparatus comprising the electro-optical device according to embodiments of the present invention.
Figure 7:
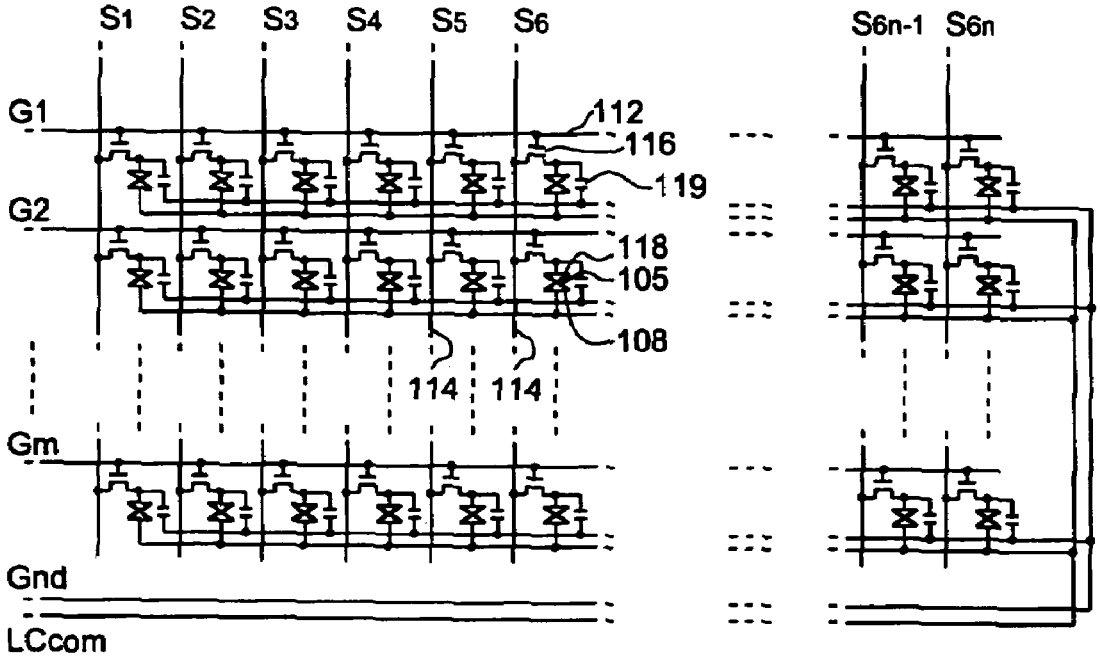
FIG. 7 is a diagram showing a conventional arrangement of a liquid crystal panel.
Figure 8:
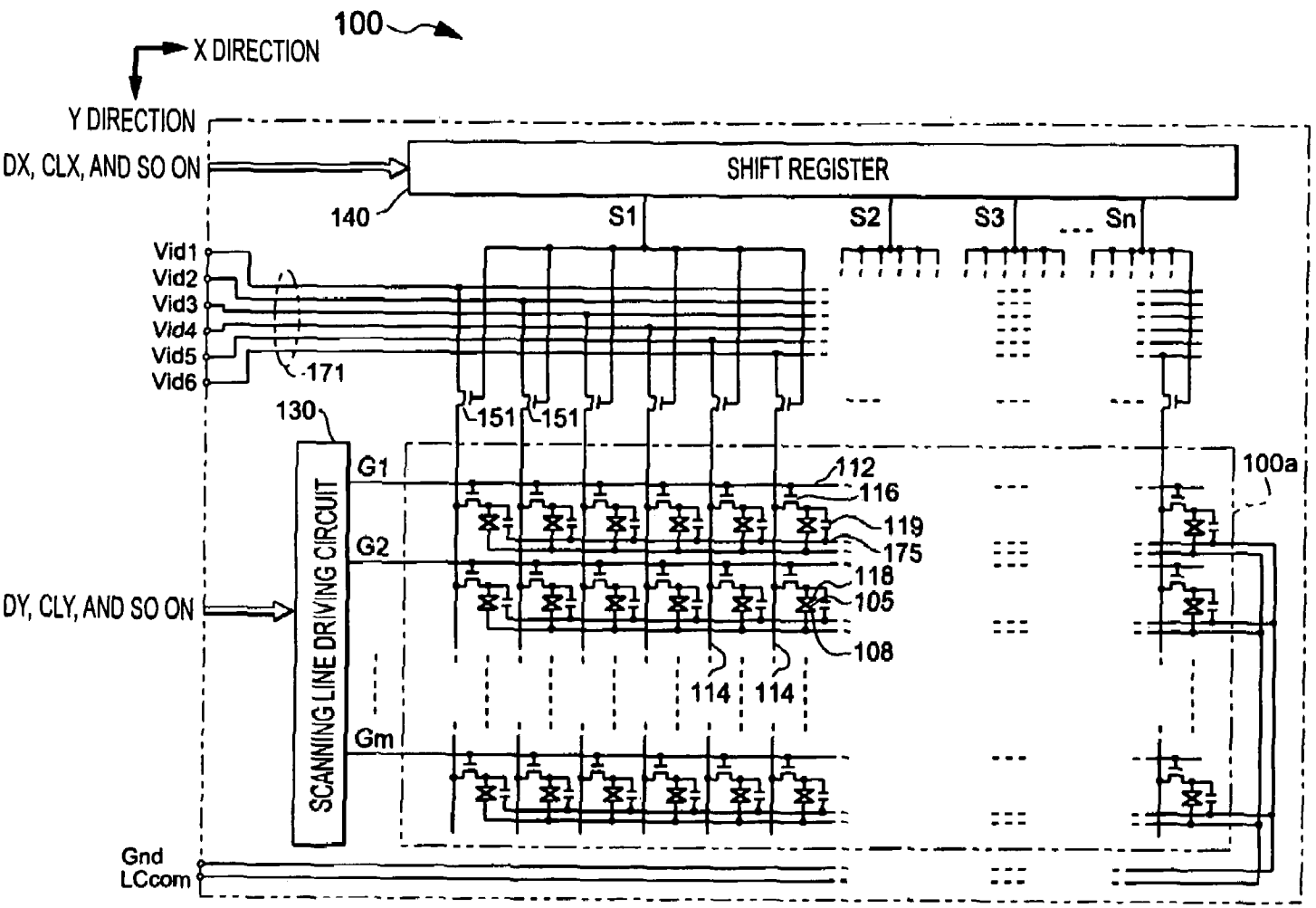
FIG. 8 is a diagram showing an arrangement of a phase expansion driving.

FIG. 6 is a plan view showing an arrangement of the projector. As shown in FIG. 6, a lamp unit 2102 comprising a white light source such as a halogen lamp is provided in a projector 2100. A transmission light component emitted from the lamp unit 2102 is divided into three primary colors, i.e., red (R), green (G), and blue (B) by means of three mirrors 2106 and two dichroic mirrors 2108, and guided into light valves 100R, 100G, 100B corresponding to the respective primary colors. In addition, compared to R or G color light, since B color light has a long optical path, it is guided by a relay lens system 2121 comprising an incident lens 2122, a relay 2123, and an emitting lens 2124 to prevent its loss.

Here, an arrangement of the light valves 100R, 100G, and 100B is the same as that of the liquid crystal panel 100 in the above-mentioned embodiments, and the respective light valves are driven by the image signals corresponding to the respective R, G, and B colors supplied from the processing circuit (not shown in FIG. 6).

The lights modulated by the light valves 100R, 100G, and 100G are incident into the dichroic prism 2112 from three directions, respectively. In addition, the lights having the R and B colors are refracted 90 degrees at the dichroic prism 2112, while the light having the G color propagates straightly. Therefore, after the image having the respective colors is combined, a color image is projected onto a screen 2120 by means of a projection lens 2114.

In addition, since the light corresponding to the three primary colors, i.e., R, G, and B colors is incident into the light valves 100R, 100G, and 100B, by the dichroic mirror 2108, it is not necessary to arrange a color filter as described above. Further, the transmitted image of the light valves 100R and 100B is transmitted after being reflected by the dichroic prism 2112, while the transmitted image of the light valve 100G is directly transmitted. Thus, the horizontal scanning direction for the light valves 100R and 100B is opposite to that for the light valve 100G, such that a horizontally inverted image is displayed.

Further, as the electronic apparatus, in addition to some examples illustrated with reference to FIG. 6, there can be employed a mobile telephone, a personal computer, a television, a view finder type or monitor-direct-view type video tape recorder, a car navigation device, a pager, an electronic organizer, an electronic calculator, a word processor, a workstation, a video phone, a POS terminal, a digital still camera, and a touch panel. In addition, it is needless to say that the electro-optic device according to the present invention can be applied to these various electronic apparatuses.

What is claimed is:

1. A method of correcting an image signal of an electro-optical panel, the electro-optical panel comprising:

a plurality of scanning lines;

a plurality of data lines grouped in blocks each having a predetermined number of data lines;

a predetermined number of image signal lines for supplying sampled image signals to the predetermined number of data lines belonging to a selected block, respectively, when the blocks are sequentially selected;

a plurality of sampling switches interposed between the data lines and the image signal lines, for sampling the image signals supplied from the image signal lines to the data lines; and a plurality of pixels arranged at intersections of the scanning lines and the data lines, in which the image signals supplied from the corresponding data lines are written, the method comprising obtaining the difference between brightness indicated by an image signal supplied to a first data line arranged at one end of a first block and brightness indicated by an image signal supplied to a second data line arranged at one end of a second block; and correcting an image signal provided to a third data line arranged at the other end of the second block using a correction signal obtained from the difference of brightness.

2. A circuit for correcting an image signal in an electro-optical panel, the electro-optical panel comprising:

a plurality of scanning lines;

a plurality of data lines grouped in blocks each having a predetermined number of data lines;

a predetermined number of image signal lines for supplying sampled image signals to the predetermined number of data lines belonging to a selected block, respectively, when the blocks are sequentially selected;

a plurality of sampling switches interposed between the data lines and the image signal lines, for sampling the image signals supplied from the image signal lines to the data lines; and a plurality of pixels arranged at intersections of the scanning lines and the data lines, into which the image signals supplied from the corresponding data lines are written, wherein the circuit for correcting the image signal comprising a first calculator for obtaining the difference between brightness indicated by an image signal supplied to a first data line arranged at one end of a first block and brightness indicated by an image signal supplied to a second data line arranged at one end of a second block; and a first adder for adding a first correction signal obtained from the difference of brightness to an image signal provided to a third data line arranged at the other end of the second block.

3. The circuit for correcting an image signal according to claim 2, further comprising:

a second calculator for obtaining the amount of difference of brightness displayed by the image signal provided to the data line arranged at the other end of the block; and a second adder for adding a second correction signal obtained from the amount of difference of brightness to the image signal provided to the data line arranged at the one end of the block.

4. The circuit for correcting an image signal according to claim 2, wherein the first calculator is provided with a first image signal supplied to a data line arranged at one end of a first block and a second image signal provided to a data line arranged at one end of a second block selected after the first block;

the first calculator calculates the difference of brightness between the first image signal and the second image signal; and the difference of brightness is output as the amount of difference of brightness.

5. The circuit for correcting an image signal according to claim 3, wherein the second calculator is provided with a third image signal supplied to a data line arranged at the other end of the first block and a fourth image signal supplied to a data line arranged at the other end of the second block;

the second calculator calculates the difference of brightness between the third image signal and the fourth image signal; and the difference of brightness is output as the amount of difference of brightness.

6. The circuit for correcting an image signal according to claim 4, further comprising:

a first delay device for delaying the first image signal to output to the first calculator, wherein the first calculator calculates the difference of brightness between the first image signal delayed by the first delay device and the second image signal.

7. The circuit for correcting an image signal according to claim 5, further comprising:

a second delay device for delaying the third image signal to output the third signal to the second calculator, wherein the second calculator calculates the difference of brightness between the third image signal delayed by the second delay device and the fourth image signal.

8. The circuit for correcting an image signal according to claim 6, wherein the first delay device delays the first image signal by a time required for selecting a block.

9. The circuit for correcting an image signal according to claim 7, wherein the second delay device delays the third image signal by a time required for selecting a block.

10. The circuit for correcting an image signal according to claim 3, further comprising:

a first multiplier for multiplying the amount of difference of brightness calculated by the first calculator by a predetermined coefficient to generate the first correction signal; and a second multiplier for multiplying the amount of difference of brightness calculated by the second calculator by a predetermined coefficient to generate the second correction signal.

11. The circuit for correcting an image signal according to claim 4, wherein the first adder adds the first correction signal to the image signal provided to the data line arranged at the other end of the second block.

12. The circuit for correcting an image signal according to claim 4, wherein the second adder adds the second correction signal to the image signal provided to the data line arranged at the one end of the second block.

13. The circuit for correcting an image signal according to claim 3, wherein the first calculator is provided with a reference signal and the image signal supplied to the data line arranged at the one end of the block, and calculates the difference of brightness between the image signal and the reference signal to output the difference of brightness as the amount of difference of brightness, and the second calculator is provided with a reference signal and the third image signal provided to the data line arranged at the other end of the block, and calculates the difference of brightness between the image signal and the reference signal to output the difference of brightness as the amount of difference of brightness.

14. An electro-optical device implemented with an electro-optical panel comprising:

a plurality of scanning lines;

a plurality of data lines grouped in blocks each having a predetermined number of data lines;

a predetermined number of image signal lines for supplying sampled image signals to the predetermined number of data lines belonging to a selected block, respectively, when the blocks are sequentially selected;

a plurality of sampling switches interposed between the data lines and the image signal lines, for sampling the image signals supplied from the image signal lines to the data lines; and a plurality of pixels arranged at intersections of the scanning lines and the data lines, into which the image signals supplied from the corresponding data lines are written, and a correction circuit for obtaining the amount of difference between brightness indicated by an image signal supplied to a first data line arranged at one end of a first block and brightness indicated by an image signal supplied to a second data line arranged at one end of a second block, and for correcting an image signal supplied to a third data line arranged at the other end of the second block using a correction signal obtained from the amount of difference of brightness.

15. An electronic apparatus comprising the electro-optical device according to claim 14.

* * * * *